US010913521B1

(12) United States Patent
Maresh

(10) Patent No.: US 10,913,521 B1
(45) Date of Patent: Feb. 9, 2021

(54) WATERCRAFT PROPULSION APPARATUS HAVING DIRECTED THRUST CAPABILITY

(71) Applicant: Joseph D Maresh, West Linn, OR (US)

(72) Inventor: Joseph D Maresh, West Linn, OR (US)

( * ) Notice: Subject to any disclaimer, the term of this patent is extended or adjusted under 35 U.S.C. 154(b) by 0 days.

(21) Appl. No.: 16/513,694

(22) Filed: Jul. 16, 2019

Related U.S. Application Data

(60) Provisional application No. 62/764,081, filed on Jul. 17, 2018.

(51) Int. Cl.
*B63H 16/20* (2006.01)
*B63H 25/02* (2006.01)
*B63H 5/125* (2006.01)

(52) U.S. Cl.
CPC ..... *B63H 16/20* (2013.01); *B63H 5/125* (2013.01); *B63H 25/02* (2013.01); *B63H 2016/202* (2013.01)

(58) Field of Classification Search
CPC ..... B63H 16/00; B63H 16/08; B63H 16/20; B63H 2016/202; B63H 5/125; B63H 25/02
USPC ..... 440/21, 26, 27, 31, 32
See application file for complete search history.

(56) References Cited

U.S. PATENT DOCUMENTS

| | | | | |
|---|---|---|---|---|
| 5,030,145 | A * | 7/1991 | Chase | B63H 16/20 440/26 |
| 6,165,030 | A * | 12/2000 | Lewis | B63H 16/14 440/30 |
| 6,905,379 | B1 * | 6/2005 | Jackson | B63H 16/20 440/30 |
| 9,302,755 | B2 * | 4/2016 | Wolfe | B63H 16/20 |
| 10,457,369 | B1 * | 10/2019 | McLaughlin | B63H 16/20 |
| 2008/0060569 | A1 * | 3/2008 | Howard | B63H 25/10 114/347 |

* cited by examiner

*Primary Examiner* — Daniel V Venne
(74) *Attorney, Agent, or Firm* — Nick A Nichols, Jr.

(57) ABSTRACT

A propulsion apparatus adapted to be installed in a watercraft may include a propeller extending below the water surface adapted to provide three hundred sixty degrees (360°) of directed vector thrust. The propulsion apparatus may include foot pedals operable by an operator in a cycling motion operatively connected to the propeller by a drive shaft interconnecting a crank gear assembly to a propeller gear assembly. The drive shaft may extend through vertically aligned concentric upper and lower conduits. The upper conduit may be fixedly secured to the watercraft and the lower conduit rotatably connected to a lower distal end of the upper conduit. The lower conduit may be rotated to direct propeller thrust to a desired direction.

8 Claims, 4 Drawing Sheets

131
120
132
116
122
135
138
134
136
144
140
139
146
143
142
114

120
116
132
131
134
136
142
146
144
114

132
122
116
120
131
138
136
140
142
146
114
139

WATERCRAFT PROPULSION APPARATUS HAVING DIRECTED THRUST CAPABILITY

CROSS-REFERENCE TO RELATED APPLICATION

This application claims priority to and the benefit of the filing date of U.S. Provisional Application Ser. No. 62/764,081, filed Jul. 17, 2018, which application is herein incorporated by reference in its entirety.

BACKGROUND

The present invention relates to propulsive drive apparatus for a watercraft having integrated thrust vectoring capability. The propulsion apparatus may be secured between opposite longitudinal ends of the watercraft, providing longitudinal and/or lateral thrust.

A need exists for watercraft to have three hundred sixty degrees (360°) of thrust vectoring capability in order to aid in station keeping on a body of water, such as rivers, lakes, harbors, open water and the like, as well as improved watercraft control when launching or beaching through waves. In the first instance, station keeping capability with thrust vectoring control allows a watercraft operator to approach, remain stationary, and withdraw while in a river current. In the second instance, such as when beaching the watercraft through surf waves, a vessel without thrust vectoring capability will often capsize. This is due to the tendency of the bow of the beaching watercraft to partially submerge in the water wave and slow down, while the forward momentum of the stern of the watercraft causes the stern to come out of the water, so the watercraft swings into a broaching position to lie broadside to the waves. Prior art watercraft having centrally located pedal drives may only propel the watercraft in the direction the hull is pointing, so it is not possible to counter broaching of the watercraft because the partially submerged bow encounters lateral resistance from the water wave so that it may not be swung back to a generally perpendicular position relative to the water wave. In such a situation, the rudder or propellers operating at the stern of the watercraft, is/are useless and may be partially or wholly out of the water proximate a wave crest and are useless to provide control of the watercraft. A centrally located thrust vectoring apparatus may be wholly in contact and submerged and engaged with the wave because it is not at a distal end of the watercraft, which enables directed thrust to be performed to prevent the stern from laterally swinging ahead of the bow while the operator counteracts and thrusts away from an unstable broaching tendency. Furthermore, in rough open water with big following waves, the stern and rudder region of the watercraft may also rise out of the water, and the stern will again swing forward resulting in capsizing. In all these instances, central thrust vectoring may greatly improve control and the safety of the operator. Such thrust vectoring may be most effective if the drive system is secured somewhat forward of the central region of the watercraft so that the propeller pulls the watercraft ahead of the broaching event.

SUMMARY

A propulsion apparatus adapted to be installed in a watercraft may include a propeller extending below the water surface adapted to provide three hundred sixty degrees (360°) of directed vector thrust. The propulsion apparatus may include foot pedals operable by an operator in a cycling motion operatively connected to the propeller by a drive shaft interconnecting a crank gear assembly to a propeller gear assembly. The drive shaft may extend through vertically aligned concentric upper and lower conduits. The upper conduit may be fixedly secured to the watercraft and the lower conduit rotatably connected to a lower distal end of the upper conduit. The lower conduit may be rotated to direct propeller thrust in a desired direction.

BRIEF DESCRIPTION OF THE DRAWINGS

So that the manner in which the above recited features, advantages and objects of the present invention are attained can be understood in detail, a more particular description of the invention briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DETAILED DESCRIPTION

Figure 1A:
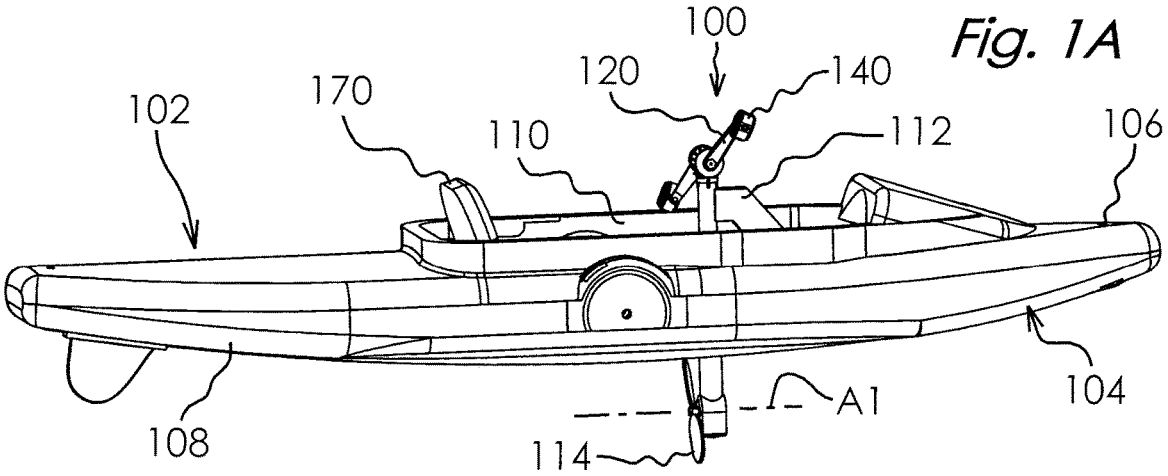
FIGS. 1A-1C are perspective views of a watercraft which includes a propulsion apparatus illustrating thrust vectoring directions of the propulsion apparatus which are parallel to, at fort-five degree (45°) and perpendicular to the longitudinal axis of the watercraft.
Figure 1B:
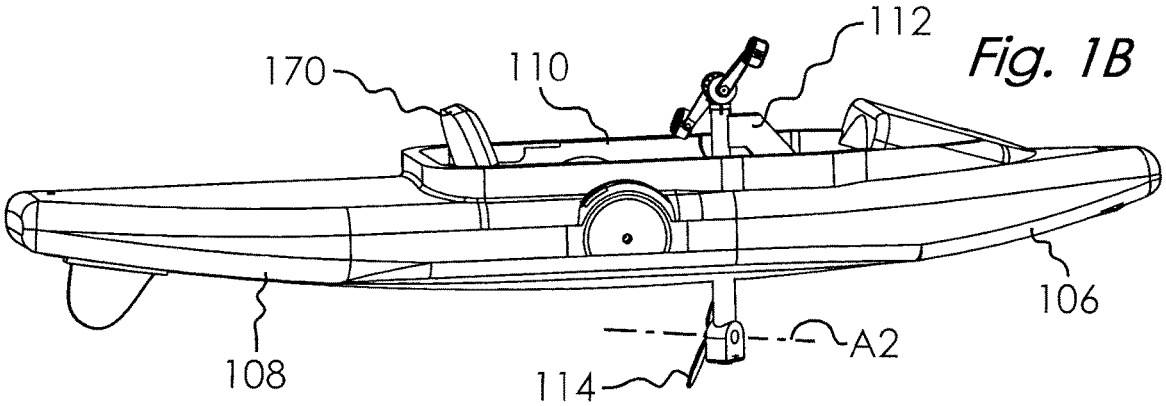
Figure 1C:
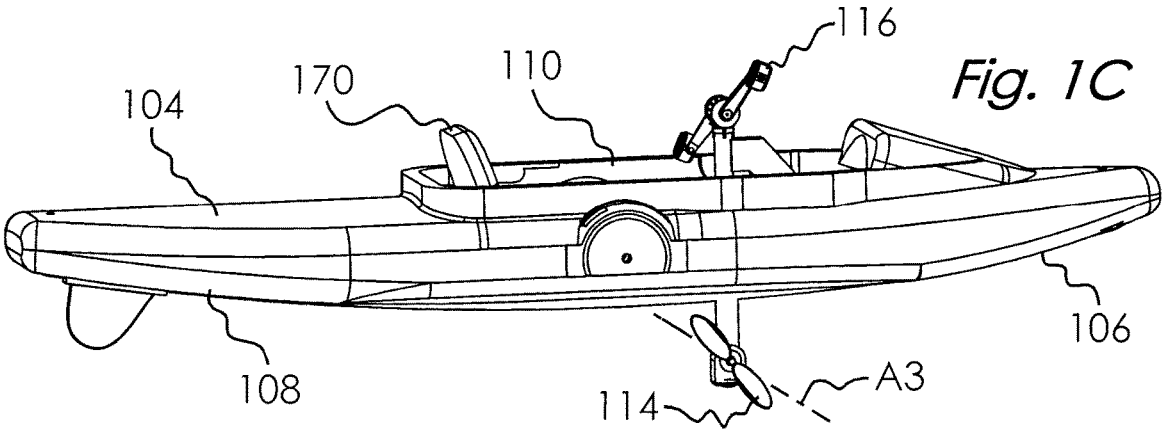

Referring first to FIGS. 1A-1C, a watercraft 102 equipped with a propulsion apparatus 100, is shown. The watercraft 102 may include a hull 104, bow 106, stern 108 and a cockpit 110. The propulsion apparatus 100 may be rigidly fixed to an upstanding support 112 secured to the floor of the watercraft 102. A lower component of the propulsion apparatus 100 may extend through an opening in the floor of the watercraft 102 so that a propeller 114 is positioned below the water surface. The watercraft 102 may include, without limitation, kayaks, boats, canoes and the like.

Figure 2A:
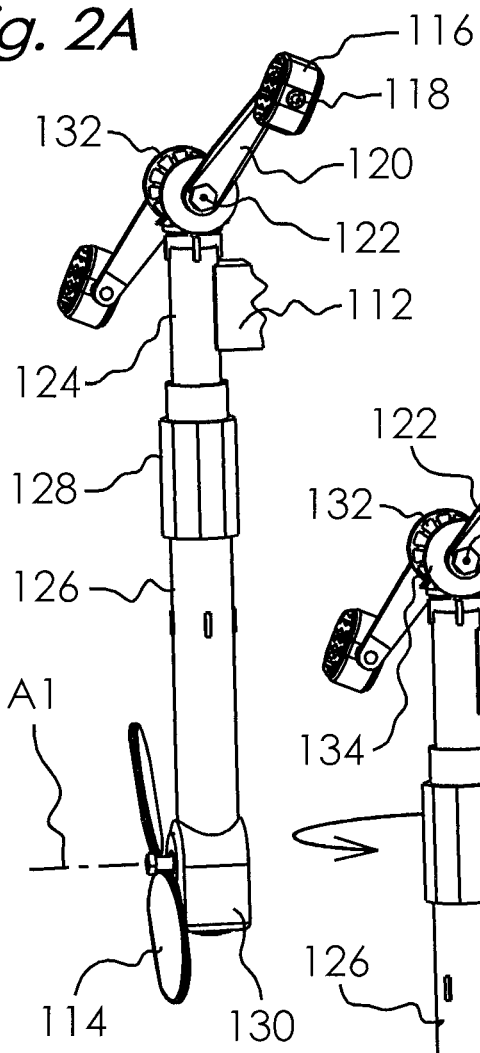
FIGS. 2A-2C are perspective views of a propulsion apparatus illustrating thrust vectoring directions of the propulsion apparatus which are parallel to, at fort-five degree (45°) and perpendicular to the longitudinal axis of the watercraft illustrated in FIGS. 1A-1C.
Figure 2B:
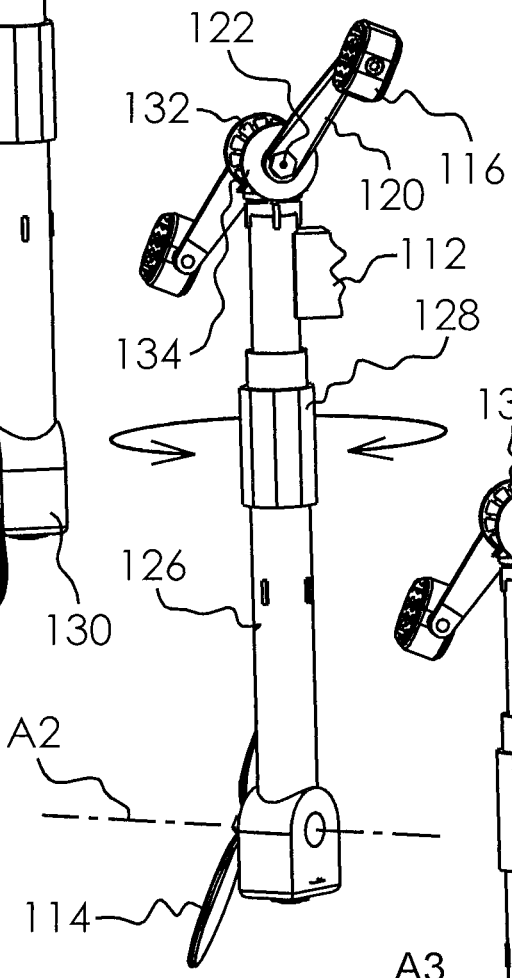
Figure 2C:
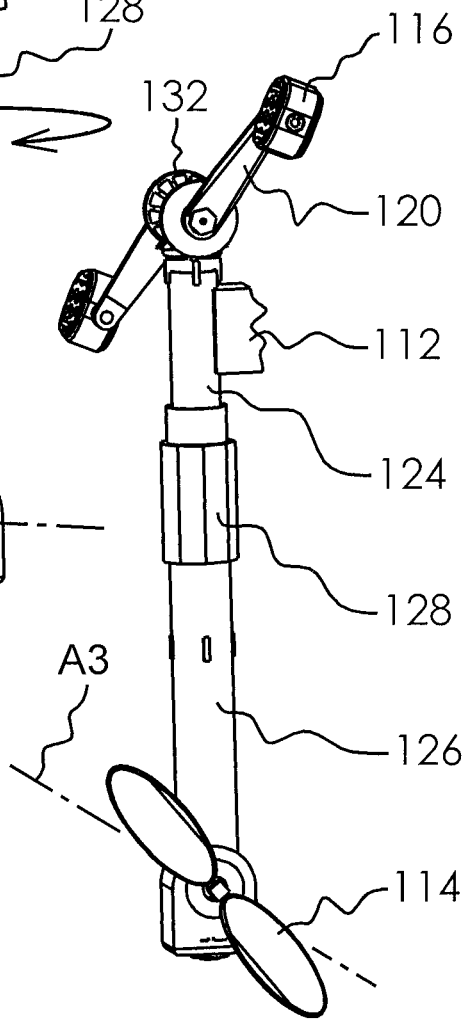

Referring now to FIGS. 2A-2C, the propulsion apparatus 100 may include foot pedals 116 rotatably secured to bearing shafts 118 which are fixedly secured to crank arms 120. The crank arms 120 may be connected to a crank shaft 122 which is rotatably secured to an upper distal end of a first conduit 124. The foot pedals 116 are rotatable about a common axis defined by the crank shaft 122.

A second conduit 126 may be rotatably connected to a lower distal end of the first conduit 124. The second conduit 126 may be vertically aligned with the first conduit 124 and rotatable relative to the first conduit 124. The propeller 114 may be rotatably secured to a gear hub 130 fixedly secured to a lower distal end of the second conduit 126. A handgrip 128 secured to the second conduit 126 may be grasped by an operator to rotate the second conduit 126 and adjust the thrust vector direction of the propeller 114 in a horizontal plane. Other unillustrated means may be provided to rotate the second conduit 126 relative to the first conduit 124. Such as but without limitation, an auxiliary gear train or pulley system and the like.

Figures 3A, 3B, 3C:
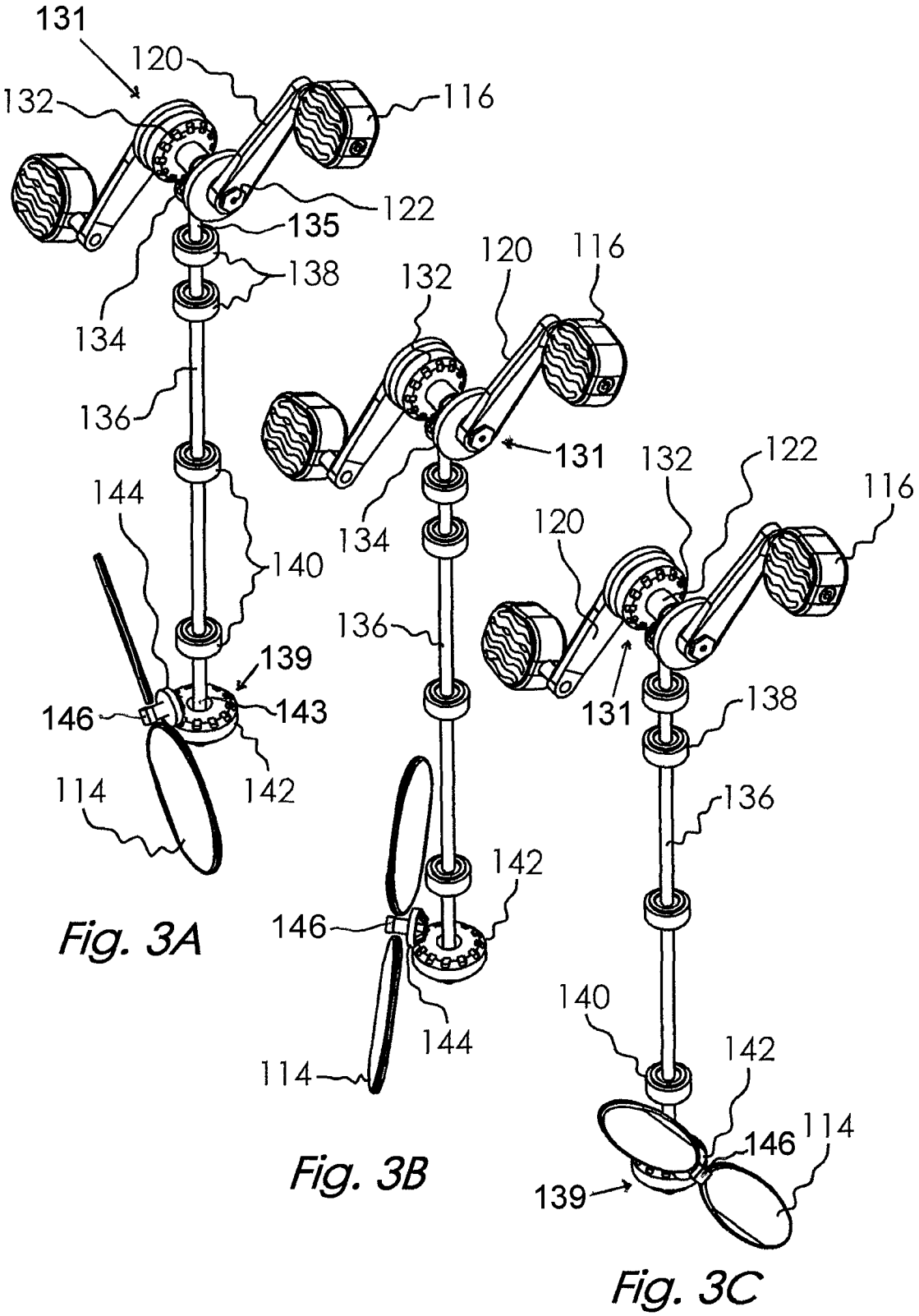
FIGS. 3A-3C are broken away perspective views of the propulsion apparatus shown in FIGS. 2A-2C illustrating thrust vectoring directions of the propulsion apparatus parallel to, at fort-five degree (45°) and perpendicular to the longitudinal axis of the watercraft.

Referring next to FIGS. 3A-3C, an upper crank gear assembly 131 may include a first bevel gear 132 fixedly secured to the crank shaft 122 and at least one crank arm 120. A second bevel gear 134 may be fixedly secured to an upper distal end 135 of an elongated drive shaft 136 operatively connected to the propeller 114. The pitch diameter of the second bevel gear 134 may be relatively smaller than the pitch diameter of the first bevel gear 132. Depending on the pitch diameter ratio, the rotational speed of the drive shaft 136 may be substantially greater than the rotational speed of the crank shaft 122. For example, but without limitation, the pitch diameter ratio may be three or four to one. That is, for each rotation of the crank shaft 122, the drive shaft 136 rotates three or four times.

One or more bearings 138 may be disposed between an upper region of the drive shaft 136 and an interior surface of the first conduit 124. One or more bearings 140 may be disposed between a lower region of the drive shaft 136 and an inner surface of the second conduit 126. In this configuration the first conduit 124 and second conduit 126 may be concentrically secured about the drive shaft 136. A propeller gear assembly 139 may include a drive shaft gear 142 fixedly secured to a lower distal end 143 of the drive shaft 136. The drive shaft gear 142 may operatively engage a propeller gear 144 fixedly secured to a propeller shaft 146. The pitch diameter of the lower gear assembly to the upper gear assembly may, for example but without limitation, be set at 10:1. That is, rotation of the propeller 114 may be ten times greater than rotation of the crank shaft 122.

Figures 4A, 4B, 4C:
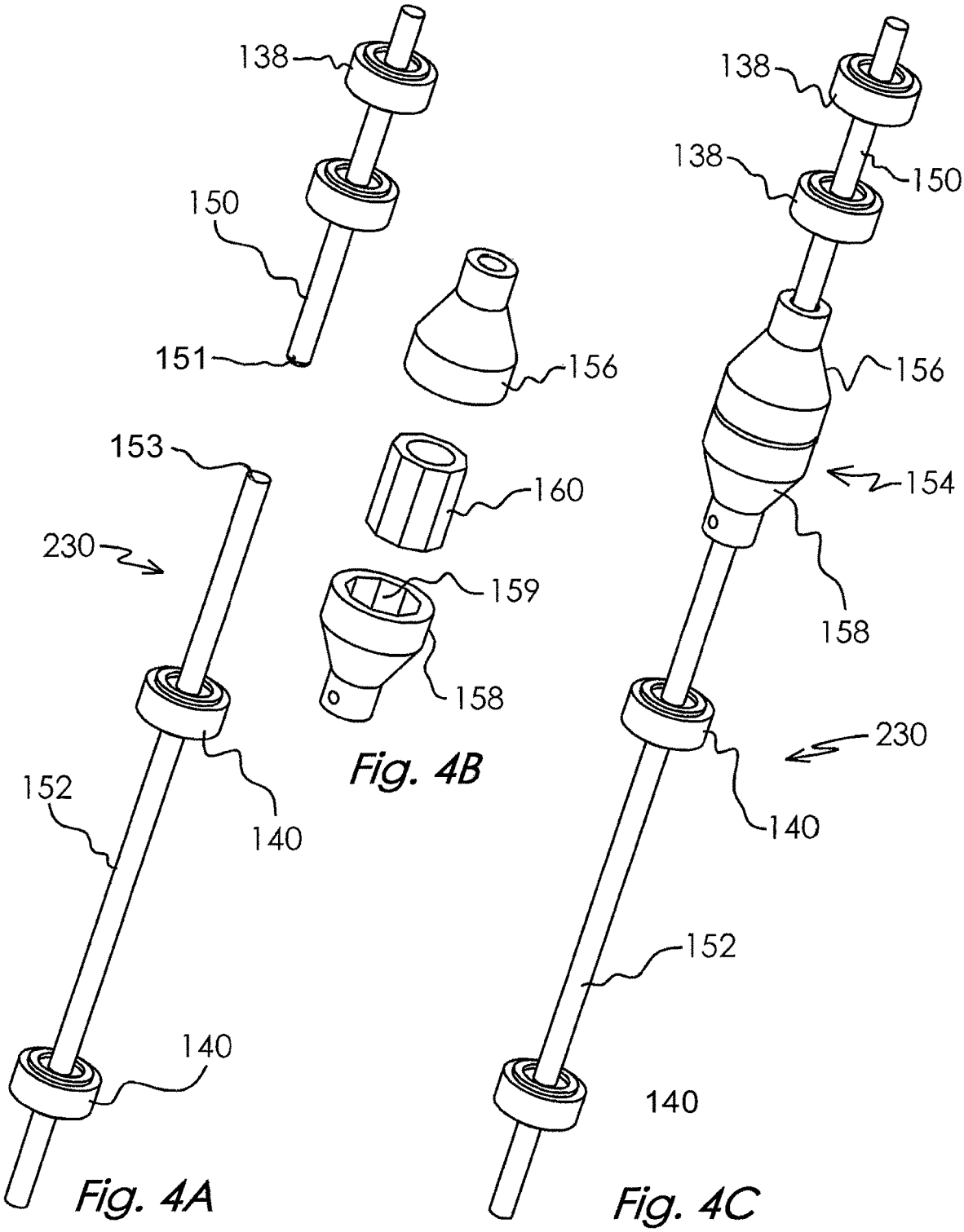
FIG. 4A is an exploded perspective view of a split drive rod of the propulsion apparatus shown in FIGS. 2A-2C.
FIG. 4B is an exploded perspective view of a coupler for the split drive rod shown in FIG. 4A.
FIG. 4C is a perspective view of an assembled split drive rod of the propulsion apparatus shown in FIGS. 4A-4B.

Referring now to FIGS. 4A and 4B, a second embodiment of a watercraft propulsion apparatus may include a split drive shaft generally identified by the reference numeral 230. The split drive shaft 230 may include an upper shaft portion 150 and a lower shaft portion 152. A coupler 154 may rotatably connect the upper and lower shaft portions 150, 152. The coupler 154 may include an upper hub 156 fixed to the lower distal end 151 of the upper shaft portion 150 and a lower hub 158 may be fixed to an upper distal end 153 of the lower shaft portion 152. The upper and lower hubs 156, 158 may include facing cavities 159 adapted to receive an intermediate coupler member 160 for rotationally connecting the upper and lower shaft portions 150, 152. The split configuration of the drive shaft 230 may facilitate the assembly of the upper and lower gear assemblies 131, 139 without concern for improper manufacturing tolerances being introduced as the first conduit 124 and second conduit 126 are rotatably mated together.

The propulsion apparatus 100 provides the watercraft 102 with three hundred sixty degrees (360°) of thrust vectoring capability. An operator may maneuver the watercraft 102 in any desired direction by rotating the second conduit 126 to change the direction of thrust applied by the propeller 114 in a horizontal plane. As indicated earlier, remote means may be provided to rotate the second conduit 126 relative the first conduit 124. The operator may be seated in a seat 170 of the watercraft 102 in a recumbent position to apply foot power to rotate the foot pedals 116 in a cycling motion. Rotation of the crank shaft 122 is transmitted to the propeller 114 through the drive shaft 136 interconnecting the crank gear assembly 131 to the propeller gear assembly 139. The thrust vector of the propeller 114 may be adjusted by the operator through three hundred sixty degrees (360°) for maneuvering the watercraft 102 in any direction.

Referring again to FIGS. 1A-1C, the orientation of the propeller 114 provides thrust to propel the watercraft 102 forward in the direction of axis A1 which is parallel to the longitudinal axis of the watercraft 102. It may be observed that reverse thrust may be provided by rotating the propeller 114 one hundred eighty degrees (180°) the orientation of the propeller 114 shown in FIG. 1A. Directing thrust in the direction of axis A2 may propel the watercraft in an angular direction. For example, but without limitation, at an angle forty-five degrees from the longitudinal axis of the watercraft 102. Thrust applied at ninety degrees (90°) or perpendicular to the longitudinal axis of the watercraft 102 in the direction of axis A3 may propel the watercraft 102 in a lateral direction, which may be advantageous for maneuvering the watercraft 102 around objects or docks and the like.

While a preferred embodiment of the invention has been shown and described, other and further embodiments of the invention may be devised without departing from the basic scope thereof, and the scope thereof is determined by the claims which follow.

The invention claimed is:

1. A watercraft propulsion apparatus, comprising:

a) a first conduit fixedly secured to a watercraft, a second conduit rotatably connected to said first conduit in vertical alignment;

b) a crank gear assembly fixedly secured to an upper distal end of said first conduit, said crank gear assembly including foot pedals coupled to crank arms fixedly secured to a crank shaft rotatably secured to said first conduit;

c) a propeller gear assembly fixedly secured to a lower distal end of said second conduit;

d) a propeller rotatably connected to said propeller gear assembly; and e) a drive shaft extending through said first conduit and said second conduit interconnecting said crank gear assembly to said propeller gear assembly, wherein cycling motion of said foot pedals rotates said propeller providing directed vector thrust in a horizontal plane.

2. The propulsion apparatus of claim 1 further including a first bevel gear fixedly secured to said crank shaft.

3. The propulsion apparatus of claim 2 further including a second bevel gear fixedly secured to an upper distal end of said drive shaft, said second bevel gear operatively engaging said first bevel gear.

4. The propulsion apparatus of claim 1 wherein said propeller gear assembly includes a drive shaft gear fixedly secured to a lower distal end of said drive shaft, said drive shaft gear operatively engaging a propeller gear fixedly connected to said propeller.

5. The propulsion apparatus of claim 1 including a handgrip secured about said second conduit for rotating said second conduit about said drive shaft to change the direction of vector thrust of said propeller.

6. The propulsion apparatus of claim 5 wherein rotation of said second conduit provides three hundred sixty degrees of directed vectoring capability.

7. The propulsion apparatus of claim 1 wherein said drive shaft comprises two elongated drive shaft portions coupled together end to end.

8. The propulsion apparatus of claim 7 further including a coupler connecting said elongated drive shaft portions to rotate together.

* * * * *